US008161849B2

(12) United States Patent
Stark

(10) Patent No.: US 8,161,849 B2
(45) Date of Patent: Apr. 24, 2012

(54) TORQUE LIMITER

(76) Inventor: Michael Curt Walter Stark, Lake Oswego, OR (US)

( * ) Notice: Subject to any disclaimer, the term of this patent is extended or adjusted under 35 U.S.C. 154(b) by 402 days.

(21) Appl. No.: 12/459,698

(22) Filed: Jul. 6, 2009

(65) Prior Publication Data

US 2011/0000347 A1 Jan. 6, 2011

(51) Int. Cl.
*B25B 23/157* (2006.01)

(52) U.S. Cl. ..... 81/473; 81/474

(58) Field of Classification Search ..... 81/473–476, 81/DIG. 5; 173/178, 93.5
See application file for complete search history.

(56) References Cited

U.S. PATENT DOCUMENTS 4,712,456 A * 12/1987 Yuan ..... 81/473
7,150,212 B2 * 12/2006 Lee ..... 81/475
7,467,576 B2 * 12/2008 Gao ..... 81/474

* cited by examiner

*Primary Examiner* — Hadi Shakeri
(74) *Attorney, Agent, or Firm* — Mark S. Hubert

(57) ABSTRACT

An adjustable torque limiter that can be coupled between a high speed driver and the socket that rotates a mechanical fastener. When a preset torque level is reached, the torque limiter disengages the rotational drive force from the bit. The adjustability of the torque limitation is accomplished by varying the amount of spring force by which a thrust plate (coupled to the high speed driver) is forced against a set of steel balls residing in slots of a radial torque plate and in a set of paths formed in a concavity of an upper torque body (coupled to the driven socket engaging stud). When a certain preset torque is transmitted from the driver to the socket, the steel balls traverse outward along the separate arced ramp radial paths therein the upper torque body until the balls enter an annular race that allows the thrust plate to go into a disengaged or free wheel mode from the upper torque body.

8 Claims, 12 Drawing Sheets

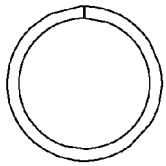
FIG. 11a
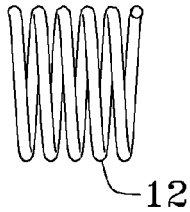
FIG. 11b
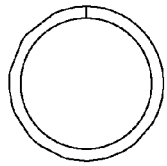
FIG. 11c
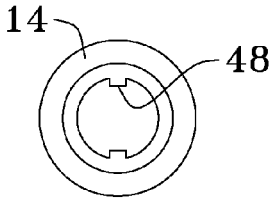
FIG. 12a
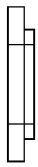
FIG. 12b
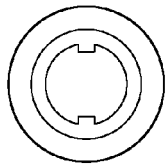
FIG. 12c
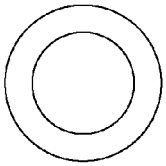
FIG. 13a
FIG. 13b
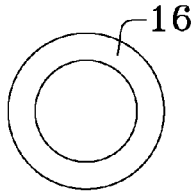
FIG. 13c

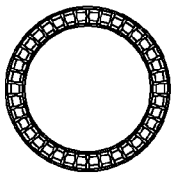
FIG. 14a
FIG. 14b
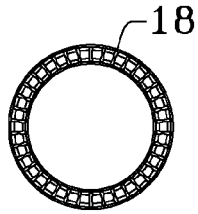
FIG. 14c
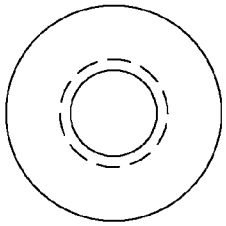
FIG. 15a
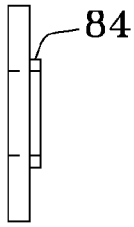
FIG. 15b
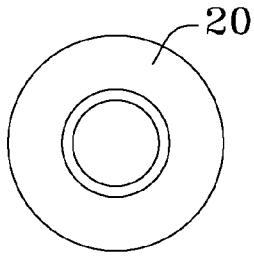
FIG. 15c

TORQUE LIMITER

BACKGROUND OF THE INVENTION

The present invention relates to a extremely sturdy and versatile torque limiting device adapted to be used in conjunction with any type of driver tool utilized for the rotational tightening of mechanical fasteners. More particularly, to an accurate torque limiting device designed to be used in a production environment where the driver it is matingly coupled to is operated pneumatically, hydraulicly or electrically at a high speed.

The proper operation of many mechanical components is, to a large degree, dictated by how the parts are assembled. Over tightening of mechanical fasteners can lead to cracked bodies, stretched and weakened bolts, stripped threads, smaller clearance tolerances, and a plethora of other maladies that can seriously affect the operation of the item in question. Similarly, under tightening of mechanical fasteners can have its own, different but potentially disastrous results. For this reason, where the tightness of a mechanical fastener is critical to the overall operation of the item, torque values are experimentally determined and assigned to the individual mechanical fasteners.

Conventional torque limiting devices are separate from the high speed production drivers used to tighten the fastener, and must be interchanged periodically as the desired torque value is approached. This slows the assembly process as conventional torque limiting devices require time to operate. Further, many of the conventional torque limiting devices (such as a torque wrench) indicate the torque level yet do not prevent that level from being exceeded.

The present device is an adjustable torque limiter that can be connected between a high speed driver and the bit that couples to and rotates the mechanical fastener. When the preset torque level is reached, the torque limiter goes into a free wheel mode therein disengaging the rotational drive force from the bit. In this mode the high speed driver may continue to rotate but the bit will remain stationary.

The adjustability of the torque limitation is accomplished by varying the amount of spring force by which a thrust disk (coupled to the high speed driver) frictionally rotates an upper torque body (coupled to the bit) through a intervening set of steel balls that are frictionally captured in an arced (or straight) depression formed in the underside of the upper torque body. When a certain preset torque limit that is being transmitted from the driver to the bit is exceeded, the upper torque body's rotation is retarded with respect to the lower torque body's rotation and the steel balls traverse downward and outwardly along separate arced and rearward ramped radial slots formed thereon a radial torque plate extending normally from the lower torque body, gradually depressing the spring and separating the radial torque plate of the lower thrust body from the thrust disc until the balls exit the distal end of their respective radial paths and enter the outer race of the upper torque body, wherein the bit and upper torque body go into a disengaged or free wheel mode. The unit is reset by a counter rotation of lower torque body with respect to the upper torque body so that the set of balls return to the proximate end of their radial paths in the radial torque plate.

Simply stated, the present torque limiter overcomes all of the stated deficiencies of the traditional prior art through the use of an adjustable force coupling system between the drive and driven ends of the unit. Henceforth, the present invention would fulfill a long felt need in the fabrication industry. This new invention utilizes and combines known and new technologies in a unique and novel configuration to overcome the aforementioned problems therein reducing assembly time and preventing unnecessary damage.

SUMMARY OF THE INVENTION

The general purpose of the present invention, which will be described subsequently in greater detail, is to provide a torque limiter that is able to overcome the problems of the prior art and provide a failsafe method of quickly tightening mechanical fasteners in a production environment to a specified torque value.

It has many of the advantages mentioned heretofore and many novel features that result in a new and improved torque limiter which is not anticipated, rendered obvious, suggested, or even implied by any of the prior art, either alone or in any combination thereof.

In accordance with the invention, an object of the present invention is to provide an improved adjustable torque limiter capable of use with a plethora of high speed drivers.

It is another object of this invention to provide an improved torque limiter capable of connection between a conventional mechanical driver and a conventional mechanical fastener bit.

It is a further object of this invention to provide an improved torque limiter capable of eliminating torque in excess of a desired preset value from being transmitted from a driver to the driven mechanical fastener.

It is still a further object of this invention to provide for an improved torque limiter capable of simple calibration.

It is yet a further object of this invention to provide an inexpensive torque limiter capable of accurate adjustment.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 11*a* is a front view of the compression spring;

FIG. 11*b* is a side view of the compression spring;

FIG. 11*c* is a rear view of the compression spring;

FIG. 12*a* is a front view of the front spring compression disk;

FIG. 12*b* is a side view of the front spring compression disk;

FIG. 12*c* is a rear view of the front spring compression disk;

FIG. 13*a* is a front view of the wear disk;

FIG. 13*b* is a side view of the wear disk;

FIG. 13*c* is a rear view of the wear disk;

FIG. 14*a* is a front view of ring bearing;

FIG. 14*b* is a side view of the ring bearing;

FIG. 14*c* is a rear view of the ring bearing;

FIG. 15*a* is a front view of the trust disk;

FIG. 15*b* is a side view of the trust disk;

FIG. 15*c* is a rear view of the trust disk;

DETAILED DESCRIPTION

Figure 1:
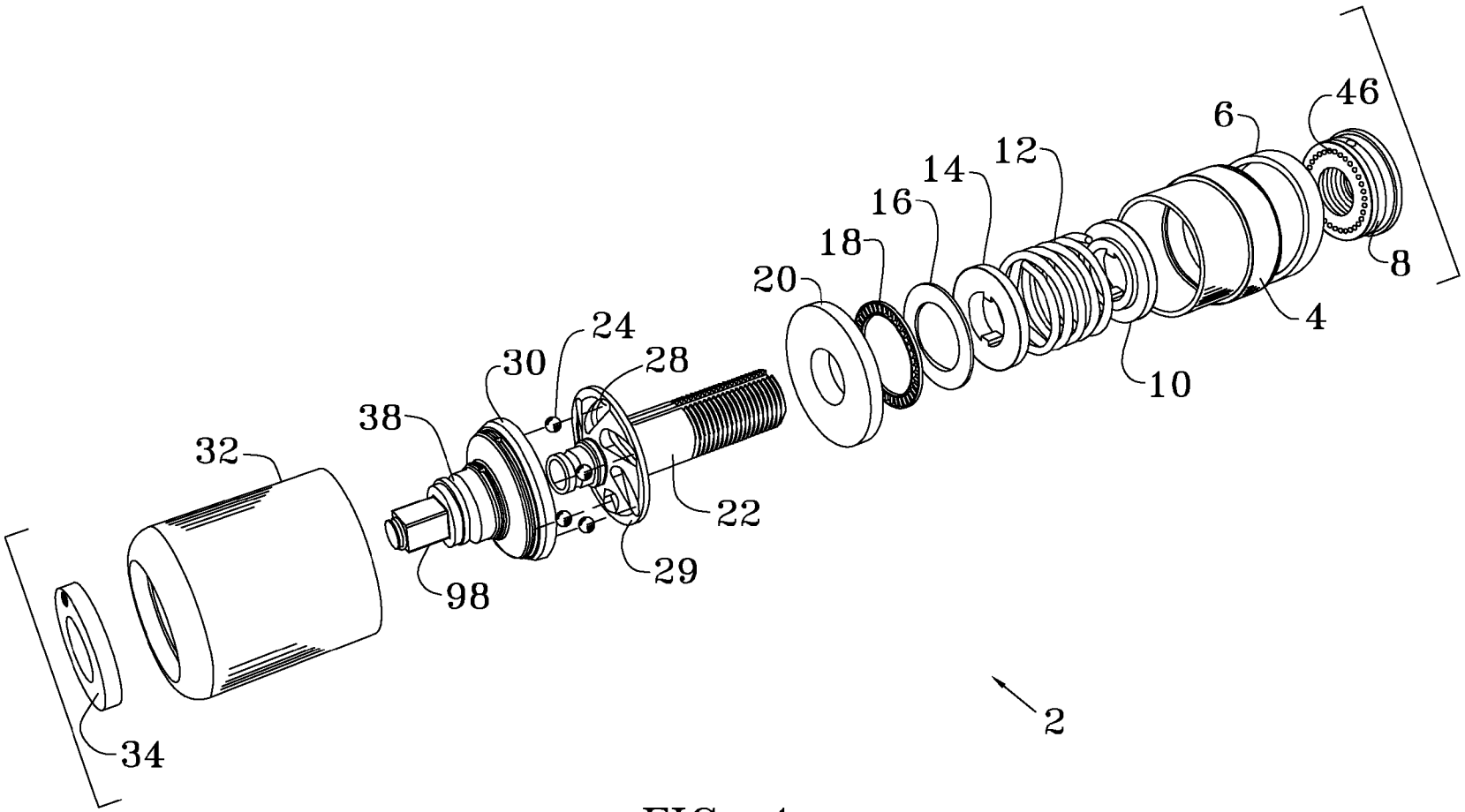
FIG. 1 is a front side exploded view of the improved adjustable torque limiter.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

In the most basic description, the torque limiter 2 is an encapsulated torque decoupling mechanism that has an upper driven body and a lower drive body coupled for unitary rotation by the frictional engagement of a set of balls residing partially in radial paths formed in a concavity of the upper driven body and partially in ramped and arced radial slots formed on a radial torque plate on the lower thrust body. The amount of friction or drag exerted by the balls (and thus the coupling force between the upper driven body and a lower drive body) is altered by adjusting the compression force that a fixed spring exerts via a thrust disk onto the balls. The adjustment of the spring and the rotation of the bodies within the encapsulation requires five sets of bearings and a plethora of structural elements. This friction or drag determines the amount of torque required to break apart the unitary rotation of the two bodies. Once this torque is exceed there is slippage between the upper and lower torque bodies forcing the balls to move downward and outward along their ramped and arced radial paths and into an outer race compressing the spring and allowing the balls to rotate around a stationary upper torque body. When this occurs the drive body is free to rotate uncoupled from the driven body. To accomplish unitary rotation again, the drive body rotation must stop and the drive body rotated slightly in a reverse rotation to reset the position of the set of balls in their paths.

Figure 2:
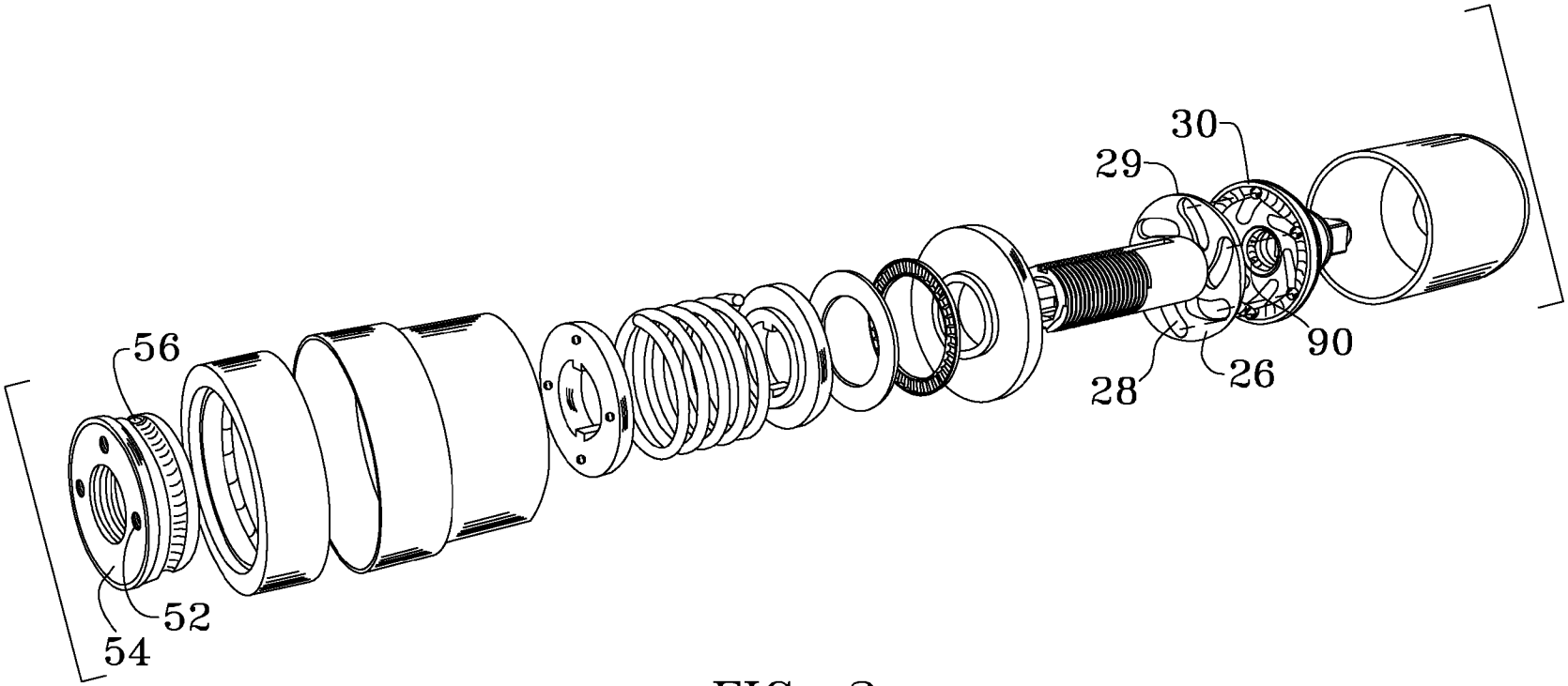
FIG. 2 is rear side exploded view of the improved adjustable torque limiter.

A detailed explanation of the improved torque limiter 2 as well as the functionality and structure of all its components can best be seen by looking at FIGS. 1 and 2. Here it is shown that the adjustable torque limiter 2 is made of a rear cylindrical housing 4 that constrains a lower outer race ring 6 affixed or formed at its proximate end. A set of lower housing balls 40 (FIG. 6) affixes the lower housing 4 to an internally threaded torque adjuster plate 8. The adjuster plate 8 contacts the rear spring location compression disk 10 which compresses spring 12 so as to exert a linear force upon front spring location compression disk 14 which is transmitted to the rear side 26 of the radial torque plate 29 of the lower torque body 22 through the wear disk 16, bearing plate 18 and thrust disk 20. Thrust balls 24 reside in ramped and arced radial slots 28 of the radial torque plate 29 so as lie between, yet simultaneously contact, thrust disk 20 and upper torque body 30. Two sets of stabilizer balls 42 reside between lower torque body 22 and upper torque body 30 in two sets of conforming races so as to stabilize the upper torque body 30 when undergoing rotation movement relative to the lower torque body 22. (FIG. 6) Upper torque body 30 extends through front bearing outer race ring 34 which is affixed in the distal end of front cylindrical housing 32. Upper housing balls 36 (FIG. 6) separate yet connect upper torque body 30 to the front housing 32 by placement within groove 38 and a matingly engagable configuration in the front bearing outer race ring 34. Front housing 32 is sized for sliding engagement over rear housing 4 so as to protect all the internal components and act as both a torque scale and a stationary surface to hold the improved torque limiter 2 as the internal components rotate.

Figure 6:
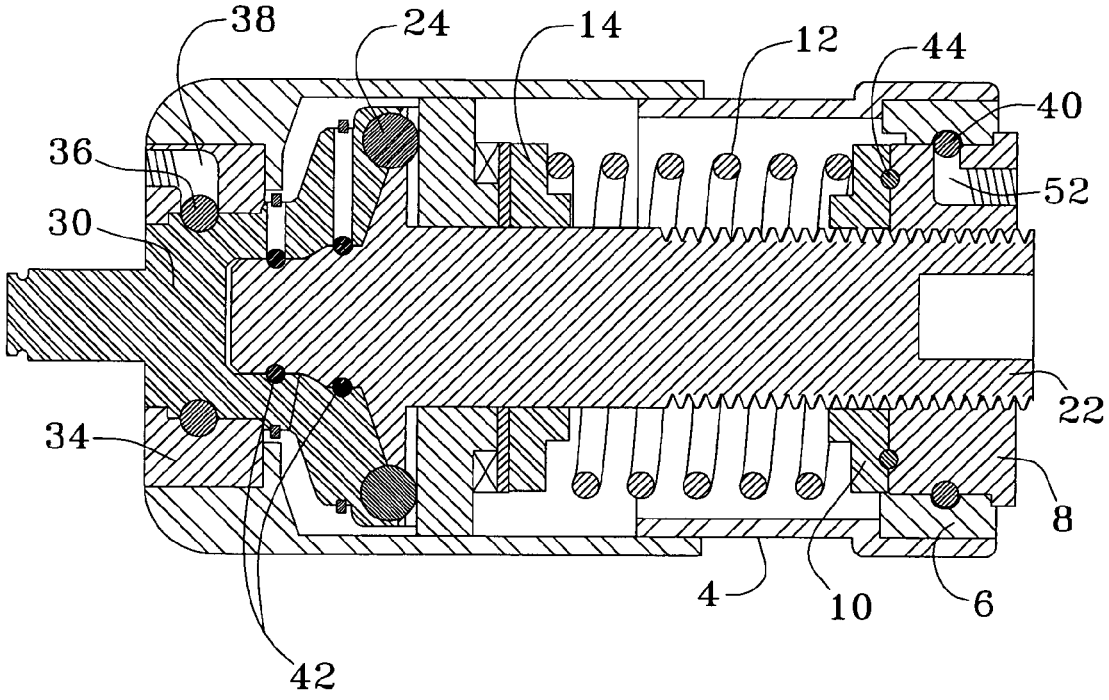
FIG. 6 is cross sectional view of the improved adjustable torque limiter taken through section A-A of FIG. 4.

Looking at FIG. 6 the placement of the five different sets of balls can best be seen. It is these balls that both connect and allow rotation between the various components. The thrust balls 24 rotationally couple the upper torque body 30 and the lower torque body 22 as well as allow decoupled rotation between the upper torque body 30 and the lower torque body 22 when the threshold torque limit has been reached. The two rows of stabilizer balls 42 connect yet allow rotation between the upper torque body 30 and the lower torque body 22 but more importantly, act to stabilize the longitudinal axis of the torque limiter 2 to minimize wear and wobble regardless of whether the threshold torque limit has been reached. The upper housing balls 36 connect yet allow the upper torque body 30 to rotate independently of the upper housing 32 and outer race ring 34. The lower housing balls 40 allow the lower torque body 22 and the torque adjuster plate 8 to rotated independently of the lower housing 4 and lower outer race ring 6 while connecting the lower housing 4 to the torque adjuster plate 8.

Additionally, three or more adjuster balls 44 (and optionally a locking pin) are secured in the rear spring location compression disk 10. The torque adjuster plate 8 has a ring of equidistantly spaced detents 46 that matingly conform to the adjuster balls 44. When the torque adjuster plate 8 is rotationally engaged with the threaded end of the lower torque body 22 so as to advance, the rear spring location compression disk 10 is also forced to advance up the threaded end of the lower torque body 22. Since the rear spring location compression disk 10 has two internal tabs 48 that engage the two longitudinal broachways 50 cut along the threaded portion of the lower torque body 22, the rear spring location compression disk 10 does not rotate relative to the lower torque body 22. This allows the compression of the spring 12 without any twisting that would distort the compression profile of the spring 12, and make the precise linear torque threshold indication impossible. The adjuster balls 44 reduce the friction between the torque adjuster plate 8 and the rear spring location compression disk 10 when the torque is being adjusted, and lock into the ring of equidistantly spaced detents 46 to prevent separation between the torque adjuster plate 8 and the rear spring location compression disk 10 when the torque adjuster plate 8 has been sufficiently advanced along the threaded end of the lower torque body 22. It is also known that in an alternate embodiment not illustrated, a more positive engagement between the torque adjuster plate 8 and the rear spring location compression disk 10 could be accomplished through the use of a set or dog screw advancing through a threaded recess in the torque adjuster plate 8 so as to partially engage a matingly sized detent in the rear spring location compression disk 10. This would serve to lock the torque adjuster plate 8 to the rear spring location compression disk 10 therein preventing any unwanted decompression of the spring 12 once the limiting torque has been set.

Since the various components of the torque limiter 2 are held together by balls, there are specific ways to get the balls into their desired locations. Although the thrust balls 24 may be manually inserted during assembly, and the adjuster balls 44 are permanently affixed into the rear spring location compression disk 10, all other balls require insertion through partially threaded externally accessible passages that then are sealed by set screws or equivalent methods.

The lower housing balls 40 are inserted through first passage 52 (FIGS. 6 and 10) in the torque adjuster plate 8. This first passage 52 has an "L" path that begins on the torque adjuster plate rear face 54 and exits in torque adjuster plate groove 56. When all the lower housing balls 40 have been inserted a set screw (not illustrated) is threadingly engaged into the first passage 52 to constrain the lower housing balls 40.

The two sets of stabilizer balls 42 are inserted through second passage 58 and third passage 60 (FIGS. 6 and 18) in the upper torque body 30. These passages are defined by axial paths. When all the stabilizer balls 42 have been inserted, pins are inserted into the passages and lock rings 39 are engaged around a ring groove so as to constrain the pin and stabilizer balls 42.

Figure 20A:
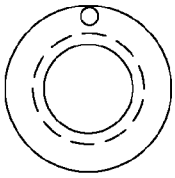
FIG. 20*a* is a front view of the front bearing race ring.
Figure 20B:
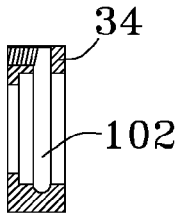
FIG. 20*b* is a side view of the front bearing race ring.
Figure 20C:
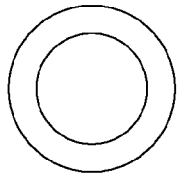
FIG. 20*c* is a rear view of the front bearing race ring.

The upper housing balls 36 are inserted through fourth passage 62 (FIGS. 6 and 13 20) in the front bearing 5 race ring 34. This fourth passage 62 has an "L" path that begins on the front bearing race ring front face 64 and exits in the groove 38. When all the upper housing balls 36 have been inserted a set screw (not illustrated) is threadingly engaged into the fourth 10 passage 62.

Figure 3:
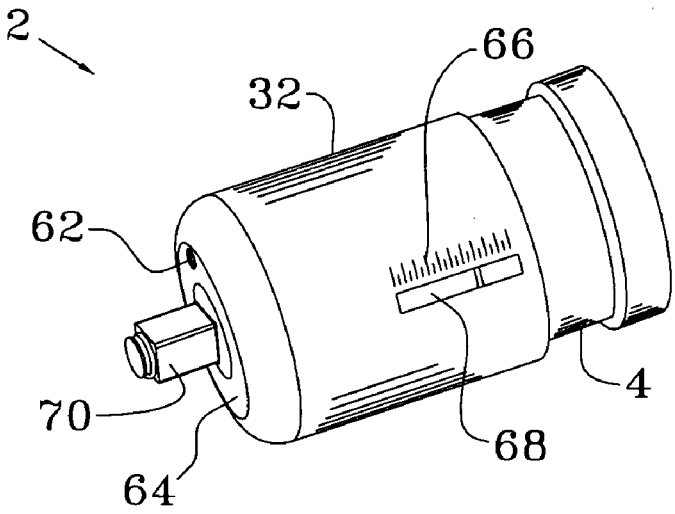
FIG. 3 is a side perspective view of the assembled improved adjustable torque limiter.
Figure 4:
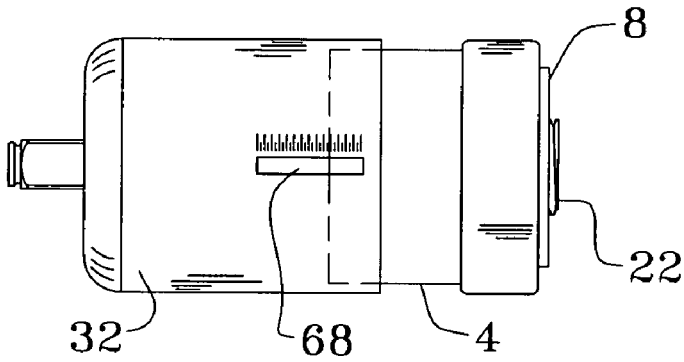
FIG. 4 is a side view of the improved adjustable torque limiter.

Looking at FIGS. 3 and 4, perspective views of the assembled torque limiter 2, the decoupling torque scale 66 can be seen. This is a linear scale that coincides with the friction transmitted by the spring 12, onto the thrust disk 20 the since the spring utilized has a linear coefficient throughout the range of spring compression utilized in the torque limiter 2. The torque scale 66 simply reflects the relative position of the rear cylindrical housing 4 within the front cylindrical housing 32 since the rear cylindrical housing 4 is affixed to the torque adjuster plate 8 and compresses the spring 12 by threaded advancement along the threaded end of the lower torque body 22. The scale 66 surrounds a slot 68 that allows better visual alignment of the edge of the rear cylindrical housing 4 with the scale 66. As is well known in the art an adjustable indicator can be installed on the rear cylinder housing 4 or the torque scale 66 can be made to adjust its location on the front cylindrical housing 32. It is also well known in the industry that the scale 66 could be placed on the lower housing 4 rather than the upper housing 32, since it only measures the relative position of each of the housings with respect to each other (which is directly proportional to the amount of compression exerted by the spring 12.)

Figure 5:
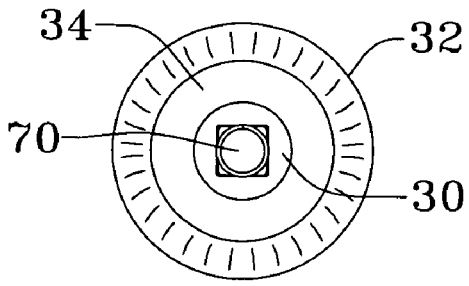
FIG. 5 is a front view of the improved adjustable torque limiter.

FIG. 5 illustrates the front end of the torque limiter 2. The proximate end of the upper torque body 30 and the socket engaging stud 98 can be seen extending through the front bearing race 34. Although shown as a separate element, it is known that in an alternate embodiment the front bearing race 34 and upper housing 32 may be fabricated as a unitary element.

Figure 7A:
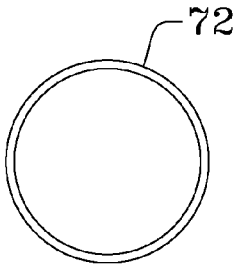
FIG. 7*a* is a front view of the rear housing.
Figure 7B:
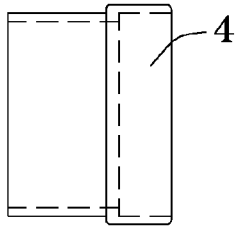
FIG. 7*b* is a side phantom view of the rear housing.
Figure 7C:
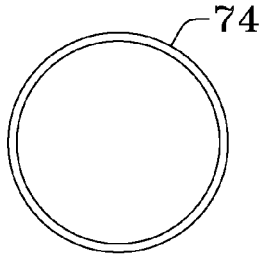
FIG. 7*c* is a rear view of the rear housing.
Figure 8A:
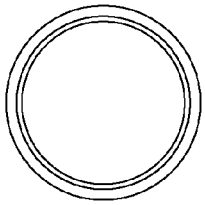
FIG. 8*a* is a front view of the rear bearing race ring.
Figure 8B:
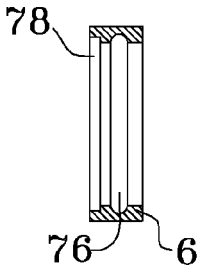
FIG. 8*b* is a side cross sectional view of the rear bearing race ring.
Figure 8C:
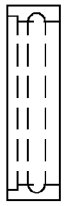
FIG. 8*c* is a side phantom view of the rear bearing race ring.
Figure 8D:
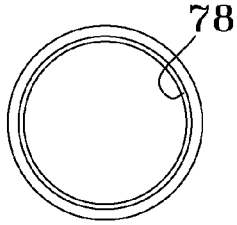
FIG. 8*d* is a rear view of the rear bearing race ring.
Figure 9C:
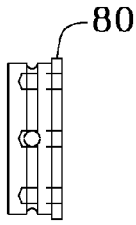
FIG. 9*c* is a top view of the torque adjuster plate.
Figure 9A:
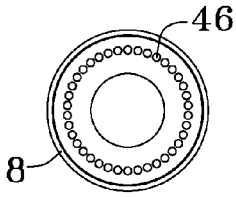
FIG. 9*a* is a front view of the torque adjuster plate.
Figure 9B:
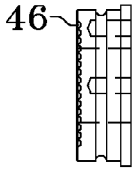
FIG. 9*b* is a side view of the torque adjuster plate.
Figure 9D:
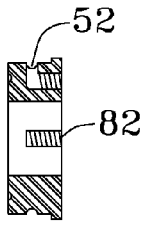
FIG. 9*d* is a side cross sectional view of the torque adjuster plate.
Figure 9E:
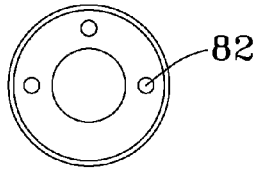
FIG. 9*e* is a rear view of the torque adjuster plate.

FIG. 7*a-c* shows the rear cylindrical housing 4 wherein it can be seen that the stepped cylindrical configuration having a smaller diameter proximate end 72 and a larger diameter distal end 74 accommodates and constrains the lower outer race ring 6. The lower outer race ring 6 has a circumferential groove 76 formed thereon to accept the lower housing balls 40 (FIG. 8*a-d*) and a circumferential shoulder 78 that the outer torque adjuster plate flange 80 (FIG. 9*a-e*) rests upon.

Figure 10A:
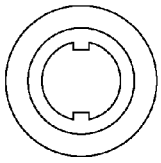
FIG. 10*a* is a front view of the rear spring compression disk.
Figure 10B:
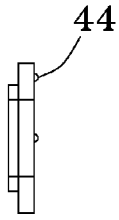
FIG. 10*b* is a side view of the rear spring compression disk.
Figure 10C:
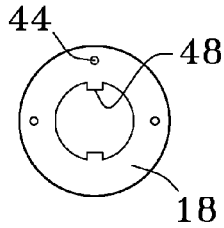
FIG. 10*c* is a rear view of the rear spring compression disk.
Figure 16A:
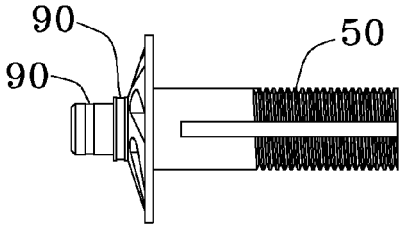
FIG. 16*a* is a top view of the lower torque body.
Figure 16B:
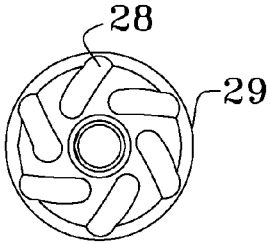
FIG. 16*b* is a front view of the lower torque body.
Figure 16C:
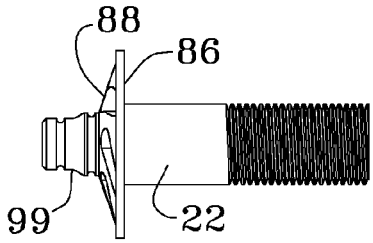
FIG. 16*c* is a side view of the lower torque body.
Figure 16D:
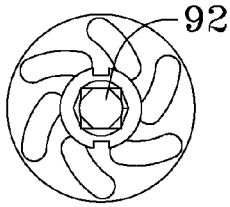
FIG. 16*d* is a rear view of the lower torque body.

The torque adjuster plate 8 is an disk that is internally threaded so as to matingly engage the threaded end of the lower torque body 22. There are two tool recesses 82 formed therein the distal face for the insertion of a pronged tool to rotate the torque adjuster plate 8. There is also a first passage 52 to allow the lower housing balls 40 to be installed. On the proximate face there is a circular series of equidistant detents 46 formed to jointly receive the equidistantly spaced adjuster balls 44 which are pressed into accommodating recesses (not illustrated) in the rear spring location compression disk 10 (FIG. 10).

To ensure that the spring 12 when compressed will not twist and adjust its linear spring coefficient, the rear spring location compression disk 10 has two internal tabs 48 that lock the rear spring location compression disk 10 to the lower torque body 22, preventing rotation relative to the lower torque body 22.

The spring 12 illustrated in FIG. 11 is a coil wound compression spring that has a linear spring coefficient across the range of compression utilized.

The front spring location compression disk 14 (FIG. 12) is similar to the rear spring location compression disk 10 with the elimination of the adjuster balls 44 and their recesses. It is also designed to eliminate any spring twist with its own set of internal tabs 48.

Looking at FIGS. 13-15 it can be seen that the wear disk 16 is a plain flat circular washer that acts as a replaceable smooth surface for the bearing plate 18 to act against. The bearing plate 18 is a conventional needle bearing disk that allows the rotation of the thrust disk 20 from the front spring location compression disk 14. There is raised flange 84 on the thrust disk 20 that is sized to constrain the bearing plate 18 so as to minimize any lateral movement.

The lower torque body 22 has a threaded distal end with two longitudinal broachways 50 cut along the threaded end. A radial torque plate 29 extends normally therefrom a forward section of the lower torque body. Into the torque plate 29 are ramped and counter clockwise arced radial slots 28 formed therethrough sized to slidingly accommodate thrust balls 24. The torque plate distal face 86 is planar while the torque plate proximate face 88 is ramped. The ramp thickness of the torque plate 29 increases toward the center. The proximate end of the lower torque body 22 has two parallel and adjacent stabilizer grooves 90 that act as inner races for sets of stabilizer balls 42. (FIG. 2) In the distal end of the lower torque body 22 there is a square recess 92 sized to accommodate a rotating power driver such as a pneumatic ratchet, although any configured recess or boss that matingly conforms to the configuration of the driver can be utilized.

Referring now to FIG. 18*a-d* the upper torque body 30 has a dished or concave distal end with grooved, clockwise arced radial paths 94 tapering deeper toward its center. The center of the distal end has a blind orifice 96 to accommodate the proximate end stub shaft 99 of the lower torque body 22, and has two stabilizer tracks 38 (FIG. 2) that act as outer races for sets of stabilizer balls 42. Second passage 58 and third passage 60 are defined by axial paths in the upper torque body 30. The proximate end of the upper torque body 30 has groove 38 and a socket engaging stud 98 formed thereon.

Figure 19A:
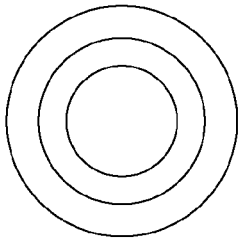
FIG. 19*a* is a front view of the front housing.
Figure 19B:
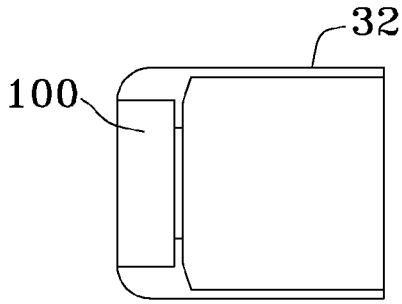
FIG. 19*b* is a side cross sectional view of the front housing.

FIGS. 19*a* and *b* shows the front cylindrical housing 32 wherein it can be seen that the proximate end has a front bearing race recess 100 to accommodate and constrain the front bearing race 34. The front bearing race 34 has a circumferential groove 102 formed thereon to accept the upper housing balls 36. (FIG. 6)

It is important to note that the upper torque body's radial paths 94 are arced in the opposite direction from the radial slots 28 formed in the radial torque plate 29 of the lower torque body 22. It is this clockwise-counterclockwise arced relationship that forces the thrust balls 24 into their outer position when the upper torque body 30 and the lower torque body 22 are decoupled (no longer frictionally engaged). Conversely, when the innermost segments of the radial slots 28 and radial paths 94 are aligned, the thrust balls 24 are constrained in their center most location and frictional engagement is achieved.

Figure 17:
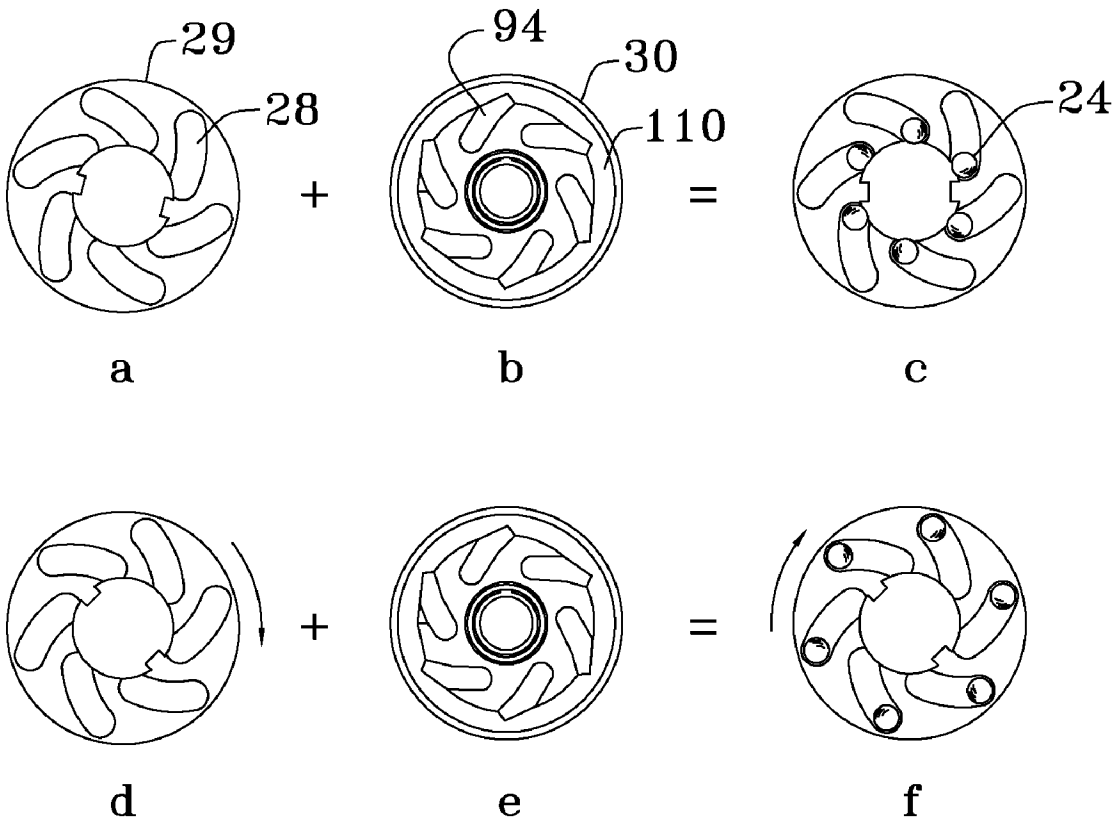
FIG. 17 is two series representations of torque ball positions within the lower torque body relative to the rotational slippage of the upper torque body.
Figure 18A:
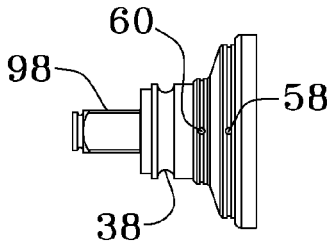
FIG. 18*a* is a top view of the upper torque body.
Figure 18B:
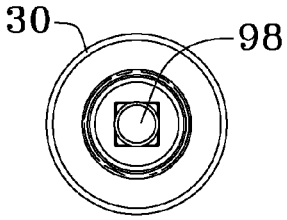
FIG. 18*b* is a front view of the upper torque body.
Figure 18C:
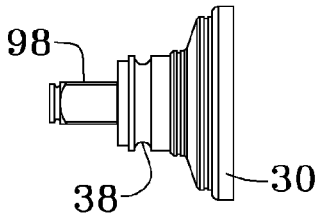
FIG. 18*c* is a side view of the upper torque body.
Figure 18D:
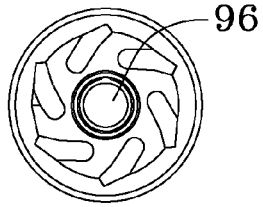
FIG. 18*d* is a rear view of the upper torque body.

The operation of the torque limiter 2 is best understood looking at looking at FIG. 1 and the two series depicted in FIG. 17*a-f*. A two pronged fork wrench, as is well known in the mechanical arts, is inserted into the tool recesses 82 on the distal face of the torque adjuster plate 8 and is rotated to advance the torque adjuster plate 8 up (or down) the threaded end of the lower torque body 22 until the desired maximum torque is indicated on the torque scale 66. The torque adjuster plate 8 also advances the rear housing 4 relative to the front housing 32 as they are connected by lower housing balls 40. Adjustment will be in uniform increments set by the engagement of the adjuster balls 44 of the rear spring compression disk 10 into the detents 46 on the proximate face of the torque adjuster plate 8. As the torque adjuster plate 8 rotationally advances up the lower torque body 22 it linearly advances the rear spring location compression disk 10 so as to compress spring 12 and increase the linear force transmitted to the thrust disk 20 through the front spring location compression disk 14, the wear disk 16 and bearing plate 18. The thrust disk 20 transmits an upward linear force upon the thrust balls 24 which are constrained at the alignment of the center most point of the radial torque plate's radial slots 28 and the upper torque body's radial paths 94 as illustrated in FIG. 17*c*. This alignment is achieved when the radial torque plate 29 and the upper torque body 30 are in the relative positions as shown in FIGS. 17*a* and *b*. Here approximately one half of the thrust balls 24 resides within the radial paths 94. As the lower torque body 22 is rotated the friction or drag of the thrust balls 24 on the thrust disk 20 and the inwardly tapered center most point of the upper torque body's radial paths 94 causes a corresponding rotation of the upper torque body 30.

When the limiting torque is reached, the application of more torque exceeds this frictional engagement and causes slippage between the upper torque body 30 and the lower torque body 22. With the rotation of the upper torque body 30 retarded (FIGS. 17*d* and *e*) the thrust balls 24 are forced along their radial paths 94 by the sides of the radial slots 28 compressing the spring 12 and increasing the distance between the thrust disk 20 and the radial torque plate 29. As the thrust balls continue moving along the radial slots 28 and the radial paths 94, the thrust balls 24 reach the free wheeling race 110 of the upper torque body 30 at which time the rotation of the upper torque body 30 ceases despite the rotation of the lower torque body 22. This is illustrated in FIG. 17*f*. The rotational retardation of the upper torque body 30 relative to the torque plate 29 that is required to force the thrust balls 24 into the free wheeling race 110 is approximately 60 degrees (in a six path torque limited) as illustrated in FIGS. 17*d* and *e*. The location of the thrust balls 24 in the radial torque plate 29 when the upper torque body 30 and lower torque body are frictionally engages is shown in FIG. 17C. The location of the thrust balls 24 in the radial torque plate 29 when the upper torque body 30 and lower torque body are decoupled is shown in FIG. 17F.

To reset the torque limiter 2 requires an advancement of the upper torque body 32 by approximately 60 degrees relative to the position of the radial torque plate 30 so that thrust balls 24 can be forced back along the radial slots 28 until the thrust balls 24 are returned to the centermost position of the radial paths 94. Since the lower torque body 22 is separated from the rear cylindrical housing 4 by lower housing balls 40, and since the upper torque body 30 is separated from the front cylindrical housing 32 by the upper housing balls 36, the device's outer housing is rotationally independent and may be held by the operator's hand while the torque limiter is operated.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. For example the number and shapes of the radial slots 28 and the radial paths 94 as well as their clockwise and counterclockwise arc directions. It is also known that the arced depressions formed in the upper housing may be straight depressions as it is the arc in the torque plate that forces the thrust balls into the decoupled position. It is also known that more than one spring may be used. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. An improved torque limiting device for a power operated rotational driver comprising:

a driven body having a proximate end with a socket engaging stud extending therefrom and a concave distal end with a central blind bore having at least one stabilizer ball outer race thereon and a series of inwardly tapering clockwise arced radial tracks that intersect an annular groove formed thereon;

a drive body having a threaded distal end with at least one longitudinal broachway therein, a proximate end with a stabilizing stub shaft for engagement into said blind bore with at least one stabilizer ball inner race thereon, and a circular radial torque plate there between that extends normally from said body having a distal planar face, a convex proximate face matingly conformed to said driven body's concave distal end, and a series of counterclockwise arced radial slots formed therethrough;

an adjustable linear thrust mechanism;

a series of steel thrust balls;

a series of steel stabilizer balls; and a housing;

wherein said steel stabilizer balls reside in said outer and inner stabilizer ball races so as to connect said driven body to said drive body, and said linear thrust mechanism includes a torque adjuster plate threadingly engaged with said drive body's distal end and further includes a thrust disk bearing against said thrust balls which reside in said slots and bear against said tracks so as to rotationally engage said drive and driven bodies within said housing.

2. The improved torque limiting device of claim 1 wherein said thrust mechanism comprises:

said thrust disk bearing against said thrust balls;

a bearing plate bearing against said thrust disk;

a wear disk bearing against said bearing plate;

a front spring location compression disk with at least one locating tab engaged therein said broachway and bearing against said wear disk;

at least one linear coil spring constrained between said front spring location compression disk and a rear spring compression disk;

a rear spring location compression disk with at least one locating tab engaged therein said broachway and bearing against said spring;

said torque adjuster plate threadingly engaged on said drive body and bearing against said rear spring compression disk.

3. The improved torque limiting device of claim 2 wherein said housing has an upper cylindrical housing that is slidingly engaged over a cylindrical lower housing.

4. The improved torque limiting device of claim 3 further comprising a torque scale affixed to said upper cylindrical housing.

5. An improved torque limiting device for a power operated rotational driver comprising:

a driven body having a proximate end with a socket engaging stud extending therefrom and a concave distal end with a central blind bore having at least one stabilizer ball outer race thereon and a series of inwardly tapering counter clockwise arced radial tracks that intersect an annular groove formed thereon;

a drive body having a threaded distal end with at least one longitudinal broachway therein, a proximate end with a stabilizing stub shaft for engagement into said blind bore with at least one stabilizer ball inner race thereon, and a circular radial torque plate there between that extends normally from said body having a distal planar face, a convex proximate face matingly conformed to said driven body's concave distal end, and a series of clockwise arced radial slots formed therethrough;

an adjustable linear thrust mechanism;

a series of steel thrust balls;

a series of steel stabilizer balls; and a housing;

wherein said steel stabilizer balls reside in said outer and inner stabilizer ball races so as to connect said driven body to said drive body, and said linear thrust mechanism includes a torque adjuster plate threadingly engaged with said drive body's distal end and further includes a thrust disk bearing against said thrust balls which reside in said slots and bear against said tracks so as to rotationally engage said drive and driven bodies within said housing.

6. The improved torque limiting device of claim 5 wherein said thrust mechanism comprises:

said thrust disk bearing against said thrust balls;

a bearing plate bearing against said thrust disk;

a wear disk bearing against said bearing plate;

a front spring location compression disk with at least one locating tab engaged therein said broachway and bearing against said wear disk;

a linear coil spring constrained between said front spring location compression disk and a rear spring compression disk;

a rear spring compression disk with at least one locating tab engaged therein said broachway and bearing against said spring;

said torque adjuster plate threadingly engaged on said drive body and bearing against said rear spring compression disk.

7. The improved torque limiting device of claim 6 wherein said housing has an upper cylindrical housing that is slidingly engaged over a cylindrical lower housing.

8. The improved torque limiting device of claim 7 further comprising a torque scale affixed to said upper cylindrical housing.

* * * * *